US005450638A

United States Patent [19]

Johnson

[11] Patent Number: 5,450,638

[45] Date of Patent: Sep. 19, 1995

[54] AUTO-INFLATING CUSHION

[76] Inventor: Mark C. Johnson, 32 Galen Ct., Seekonk, Mass. 02771-1206

[21] Appl. No.: 78,754

[22] Filed: Jun. 16, 1993

[51] Int. Cl.[6] ..... A47C 27/08

[52] U.S. Cl. ..... 5/449; 5/652; 297/DIG. 3

[58] Field of Search ..... 5/449114 458, 644, 654, 5/652; 297/DIG. 3

[56] References Cited

U.S. PATENT DOCUMENTS

| | | | |
|---|---|---|---|
| 3,533,113 | 10/1970 | Stamberger | 5/454 |
| 3,643,268 | 2/1972 | Stamberger | 5/454 |
| 3,829,918 | 8/1974 | Stamberger | 5/454 |
| 3,898,703 | 8/1975 | Stamberger | 5/454 |

*Primary Examiner*—Alexander Grosz

[57] ABSTRACT

An inflating system for use in supports, mattresses, cushions, and the like is shown. In their erect configurations, the supports have opposed, end portions interconnected to a tubular, longitudinal portion to form an airtight chamber. The longitudinal portion comprises flexible material. Transverse, vertical cross-sections of the longitudinal portion have a high surface area relative to their corresponding rectangles. These are the rectangles with equal perimeter and equal width, where width is the maximum dimension. This geometric efficiency causes the cushions to be highly supporting when stretching of the support material is limited.

The supports are inflated by moving the stiffened end portions from a horizontal configuration to a vertical one. This causes air to be drawn into the airtight chamber through a valve. The air is then trapped to form an air cushion.

Various embodiments are shown. Pulling and attaching mechanisms can facilitate erecting and inflating. The bottom portion may include a plurality of rigid members. The end portions may be stiffened by a frame. The end portions may have pockets to hold temporary stiff members. A one-way valve may be used as the intake valve. Also, the invention allows for multi-chamber embodiments.

The supports of the present invention can be used in many applications. Some of the uses contemplated include: collapsible air mattresses, portable wrist-rests, adjustable lumbar rests, and comfortable seat cushions.

16 Claims, 13 Drawing Sheets

AUTO-INFLATING CUSHION

FIELD OF INVENTION

This invention relates to inflatable cushions, supports, pillows, mattresses, and more particularly to like articles that inflate by erecting opposed, rigid end members.

DISCUSSION OF PRIOR ART

The inflating system has been a shortcoming in the design of fluid fillable products. Most fluid fillable products assume the use of the common inflating methods: A) Blow-up valve systems B) Pump and compressor systems.

There are many negative characteristics of blow-up valve systems. First, puffing a blow-up valve in one's mouth is unhygienic. This is true even if the article is used exclusively by a single person. Second, the blower's ears can experience popping and discomfort during inflation. Third, depending on the volume of air required to fill the article, the blower may be subject to hyperventilation. Fourth, also depending on the volume of air required, blowing up an inflatable article can be too time consuming.

Pump and compressor systems have their own negative characteristics. First, these tend to be expensive and can add considerably to the cost of an inflatable article. A pump or compressor can often make an inflatable article uneconomical to produce and sell.

Second, pumps and compressors can be heavy and usually tend to be bulky. These qualities are especially negative when associated with inflatable articles. Inflatable articles are often used precisely because they are light and collapsible. These benefits will be at least partially defeated if the inflating system is heavy and bulky. For example, a portable air mattress may no longer be very portable once a pump or compressor is added to the package.

Less common approaches to inflating fluid fillable articles have their own drawbacks. Fostering chemical reactions that release a gas has been used to inflate various flexible bodies. However, these systems generally require the replacement of chemicals after use.

Using springs and the like to inflate an air chamber has been applied in various forms. However, these systems are generally heavy and bulky. In other instances, the springiness is not actually strong enough to be effective.

Sealing compressed foam inside an airtight envelope has been used to expand articles. However, these systems have difficulty compressing the foam back down again. Also, the foam may lose its resilience if compressed for an extensive period.

Prior Art Showing Automatic Inflating

The automatic inflating systems, or "self-inflating" systems, shown in the prior art have more subtle differences and deficiencies. This sub-section will discuss this category of prior art. The art is primarily shown in the Stamberger designs found in U.S. Pat. No. 3,533,113, U.S. Pat. No. 3,643,268, U.S. Pat. No. 3,829,918, and U.S. Pat. No. 3,898,703.

For the purposes of this patent, geometric efficiency relates to the amount of volume that can be enclosed for a given amount of surface area and given plan dimensions. The geometric efficiency affects how supporting an automatically inflating hollow body can be.

The prior art does not use geometry effectively. The parallelepipeds described in the prior art are less efficient than the volumes covered in the auto-inflating cushion disclosed herein.

The system presented here is nearly identical with that of Stamberger U.S. Pat. No. 3,643,268. The main difference is the use of differently shaped end panels and corresponding airtight hollow bodies. The different shapes are more geometrically efficient volumes. This feature allows for greater weight supporting capacity. To put it another way, the designs of the present invention already have significantly increased internal pressure after deforming to a rectangular configuration. Stamberger's supports start at a rectangular configuration, and thus have not even begun to pressurize. Thus, the designs of the present invention provide better support than Stamberger's designs.

Geometric inefficiency places narrow constraints on the dimensions of Stamberger's design in U.S. Pat. No. 3,533,113. Note that the bellows like convolutions limit the shape of the cushion to parallelepipeds, relatively inefficient shapes. The bellows like folds also would diminish inflating efficiency because they would not unfold perfectly.

Stamberger U.S. Pat. No. 3,533,113 does allow the weight supporting walls to have dimensions to enable them to take a convex contour when inflated. This implies that the flat surfaces could be pulled and stretched into more efficient shapes. However, under such a system, achieving a well-inflated chamber is uncontrolled and unpredictable. The amount of inflating fluid entering the article depends on the amount of force used to pull open the article. It is not a predictable amount each time.

In the two Stamberger patents (U.S. Pat. No. 3,829,918 and U.S. Pat. No. 3,898,703), Stamberger realizes that his system does not draw in an adequate amount of air for effective cushioning or support. Thus, he attempts to devise some methods to further inflate his device beyond the initial inflation. This inadequate inflation is precisely due to the inefficient geometry aforementioned.

There is mention in Stamberger U.S. Pat. No. 3,533,113 that in certain embodiments of the invention, the elasticity and configuration of the expansible walls of the body are such as to enable these walls to exhibit a spring-like action. However, in practice the bellows would be more likely to act like a reverse spring. As a result, the cushion would be susceptible to collapsing back down. If springy sides were available, these could pose problems when collapsing and deflating the unit.

Another problem that Stamberger U.S. Pat. No. 3,533,113 faces is the disordering of the bellows-type folds. The convoluted folds could become folded the wrong way. This could happen after using the cushion and stretching out the bellows like sides. An embodiment of Stamberger U.S. Pat. No. 3,533,113 has a convoluted side being used as the seat or cushion. The folds could become disordered in this situation as well.

Note that the folds would have to be more complicated than those shown in Stamberger U.S. Pat. No. 3,533,113. At the corners of the bellows like convolutions, the folds shown in the diagrams would not function with the inelastic materials recommended. At the comers, the folds would have to peak out on one side.

In Stamberger U.S. Pat. No. 3,533,113, stiff or rigid construction is present in sections of the cushion that could touch the user. This would make the cushion less comfortable. Stamberger recommended that four continuous walls of the parallelepiped be convolutions of a bellows-type configuration. He also recommended that these convoluted sides be relatively stiff. Having stiffness on all sides would detract from the cushioning.

In all of the Stamberger patents, the handles that inflate the cushion are centered on two opposing surfaces. Centered handles are necessary to unfold all the convoluted sides simultaneously. In the embodiment where the handles are placed on the cushioning surface, the handles would make the cushion less comfortable. In the embodiment where the convoluted sides form the cushioning surface, the convolutions would make the cushion less comfortable.

In the Stamberger patents, because of the use of parallelepiped configurations, tension will occur at the upper comers. Thus, there exists a greater possibility of ripping at the upper comers. This will shorten the life of the article.

In an embodiment of Stamberger's design in U.S. Pat. No. 3,829,918 and U.S. Pat. No. 3,898,703 where each of the opposing end panels are clamped down in the horizontal position, the final form does not tend to cradle that which is being supported.

The prior art in Stamberger U.S. Pat. No. 3,533,113 restricts the type of materials that can be used more than the system presented here does. First, thicker materials must be used to prevent deformation into rounded, more efficient shapes. Second, the materials for the convoluted sides must be chosen so that very definite folds will be remembered. This is true unless the cushion is a single use disposable item.

In Stamberger U.S. Pat. No. 3,533,113, the bellows convolutions, once collapsed would not fold well for further compactness. First, these convolutions need to be fairly stiff to retain their shape. Second, there likely would be too much material to fold.

In U.S. Pat. Nos. 3,829,918 and 3,898,703, Stamberger discusses the addition of longitudinally placed tubes within the hollow, box-like body. This is a method by which Stamberger attempts to further inflate his device. However, this method requires the addition of extra material which results in extra cost.

OBJECTS AND ADVANTAGES

The broad object of the invention is to provide supports that automatically inflate. Automatic inflating refers to sealed hollow bodies that naturally fill with air or other fluid when the hollow body is manipulated to increase its internal volume.

A specific object of the invention is to create air cushions that are efficient in shape. This means that the volume of air contained in the chambers will be large given the chamber's surface area and plan dimensions. Efficient shapes can prevent an article from being under-inflated. For example, if an inflatable pillow is made as a low flat box, an inefficient shape, then the user's head could sink through the pillow to the supporting surface. This would occur unless the box were very tightly filled with air. However, if the pillow were made as a cylinder, a more efficient shape, then the user's head probably would not sink through to the supporting surface. This would hold true even if the cylinder were poorly inflated.

Another specific object of the invention is to provide supports that are appropriate in shape. For example, a semi-cylinder might be more appropriate than a cylinder for a pillow to prevent rolling. Some applications will warrant more efficient shapes than others.

Another specific object of the invention is to provide related articles as aforementioned that function as headrests, backrests, seat cushions, and feet cushions.

Another specific object of the invention is to provide cushions and other articles as aforementioned that feel soft and pleasant. Said articles can offer a wide, unobstructed cushioned surface.

Another specific object of the invention is to provide cushions and other articles as aforementioned that conform to the contours of that which is being supported.

Another specific object of the invention is to provide related articles as aforementioned that cradle that which is being supported.

Another specific object of the invention is to provide supports as aforementioned that form inflatable, keyboard wrist-rests.

Another specific object of the invention is to provide new types of bedsprings and mattresses.

Another specific object of the invention is to provide related articles as aforementioned that are easy and convenient to use. The automatic inflating process can be accomplished with as little as one hand. The supports require only a few seconds to inflate. In addition, the collapsing and folding of the supports is a simple operation.

Another specific object of the invention is to provide supports as aforementioned that deflate easily.

Another specific object is to provide supports as aforementioned that collapse for portability and storage.

Another specific object of the invention is to provide supports as aforementioned that are light in weight for portability and transportation.

Another specific object of the invention is to provide supports as aforementioned that can be used reliably. The amount of fluid that will inflate said articles is predictable; therefore, the cushioning properties are better controlled.

Another specific object of the invention is to provide supports as aforementioned where the inflating level can be adjusted by releasing inflating fluid.

Another specific object of the invention is to provide supports as aforementioned that take advantage of the principle of leverage or torque for inflating.

Another specific object of the invention is to provide articles as aforementioned that offer healthful benefits. This invention has uses in areas of health care. The automatically inflating process presents no hygiene problem. The user would also not be at risk of hyperventilating when inflating said articles.

Another specific object of the invention is to provide articles as aforementioned that function as packing equipment.

Another specific object of the invention is to provide articles as aforementioned that can be used repeatedly.

Another specific object of the invention is to provide articles as aforementioned that are inexpensive.

Another specific object of the invention is to provide articles as aforementioned that are durable. The rounded edges reduce the possibility of tearing.

Further objects and advantages of the present invention will become apparent from a consideration of the following drawings and descriptions.

REFERENCE NUMERALS IN DRAWINGS

Figure 1:
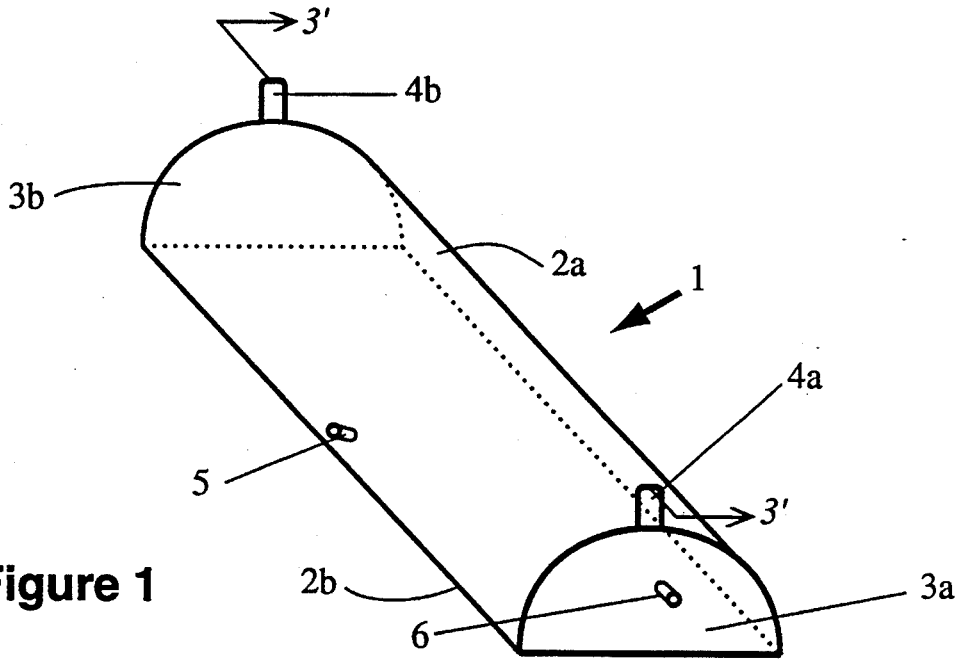
FIG. 1 is a perspective view of a single chamber support in erect, inflated configuration with semi-circular end members.

1. longitudinal portion
2. top portion and bottom portion (a and b respectively)
3. end portions (a and b)
4. erecting mechanism
5. open/close vane
6. one-way valve or check valve
7. rigid or stiff base member(s)
8. flexible seam
9. attaching mechanism
10. end pockets
11. rigid or stiff end members
12. hand
14. strap
15. jacket
16. pocket hole
17. attachment fixture
18. rectangular foundation
20. transverse, vertical cross-section
22. corresponding rectangle

SUMMARY OF INVENTION

The present invention includes a range of supports and a method for inflating them. The supports are airtight, hollow bodies. In their erect configuration the chambers have opposed, end portions 3 interconnected by a tubular, longitudinal portion 1. In their erect configuration, transverse, vertical cross-sections 20 have high surface areas relative to their corresponding rectangles 22. These are the rectangles with equal perimeter and equal width, where width is considered to be the maximum dimension.

The supports are inflated by grasping the end portions 3 that are stiffened and by moving them from a horizontal configuration to a vertical one. This causes air to be drawn into the airtight chamber through a valve 5. Valve 5 does not permit air to escape the chamber upon completion of inflating. The trapped air thus forms an air cushion.

The efficient geometry causes the supports to lose a relatively large amount of volume as they are flattened. The size and curvature of end portions 3 may be adjusted to provide the appropriate geometric volume to meet specific requirements. When volume decreases, pressure increases along with weight supporting capacity, making for highly supportive air cushions. The supports must comprise relatively inelastic material to guarantee the decrease in volume. Clearly, longitudinal portion 1, which forms top portion **2*a* and bottom portions 2*b***, must comprise flexible material for deformation to take place.

The hollow body is deflated by opening valve 5 and collapsing the airtight, hollow body portions into a planar configuration. The air is thus forced out the open valve.

The automatic inflating system has many different embodiments. Erecting tabs 4 can be provided to facilitate the erecting and inflating manipulation. The bottom portion **2*b* may include a plurality of flexibly joined, rigid members 7 to provide a firm base. The end portions may be stiffened by a wire frame or by other relatively stiff end members 11. The end portions may have pockets 10 to hold temporary, stiff end members 11. A one-way valve 6 may be used as the intake valve. Hooks on end portions 3 can attach to fixtures to permit one-hand inflating. Adhesive strips can provide extra utility. Multi-chamber embodiments are shown comprising a series of automatically inflating chambers with longitudinal portions laid side by side. One end portion shape, that of an are with a rectangular foundation 18, is particularly useful for multi-chamber embodiments. Straps 14 and jackets 15** may encase the supports.

DETAILED DESCRIPTION OF INVENTION

In accordance with the auto-inflating cushion of the present invention, an inflatable support in its erected state is illustrated in FIG. 1. The inflatable support is an airtight hollow body. This airtight chamber can be described as having a longitudinal portion 1 and two end portions **3*a* and 3*b***.

Longitudinal portion 1 forms the body of the support. Longitudinal portion 1 can be subdivided into a top portion **2*a* and a bottom portion 2*b*. Top portion 2*a* forms the top of the support. Bottom portion 2*b*** forms the base of the support.

Longitudinal portion 1 comprises relatively inelastic, flexible, strong, and air-impervious material. Longitudinal portion 1 is tubular, though not necessarily cylindrical, as shown in FIG. 1.

End portions **3*a* and 3*b* are interconnected to longitudinal portion 1 along adjacent edges. End portions 3*a* and 3*b* close the ends of tubular, longitudinal portion 1**. This achieves a closed, airtight, hollow chamber.

End portions **3*a* and 3*b* also comprise relatively inelastic, strong, and air-impervious material. In contrast, though, end portions 3*a* and 3*b*** are stiffened. In other words, they are made relatively rigid.

An erecting mechanism 4 may be mounted at each end of the support. In FIG. 1, erecting mechanisms 4*a* and 4*b* are mounted at the upper edge of each end portion 3. This is a preferred embodiment. Erecting mechanisms 4 can be, for example, the simple, tabs shown.

An open/close valve 5 is mounted on the support. Open/close valve 5 regulates the flow of air between the interior and exterior of the chamber. When open, open/close valve 5 allows air to flow between the interior and exterior of the airtight chamber. When closed, open/close valve 5 prevents such air flow through its channel. Obviously, the chamber is temporarily not airtight when open/close valve 5 is open.

In addition, a one-way valve or check valve 6 can be mounted on the airtight chamber. This embodiment is shown in FIG. 1. One-way valve 6 regulates air flow through its channel or opening. It permits the entering of air, but it does not allow air to exit the airtight, hollow body.

Figure 2:
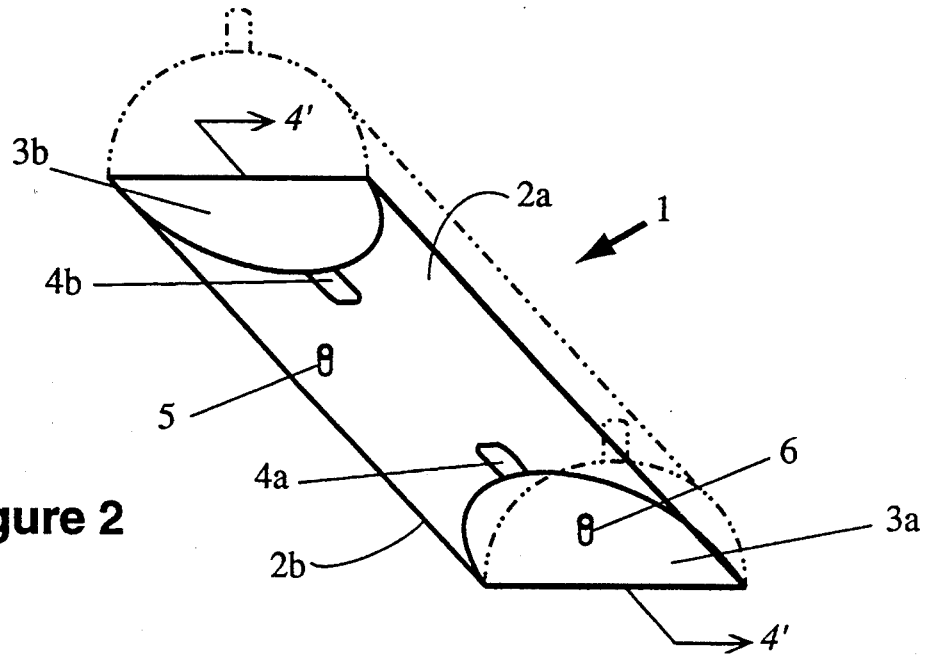
FIG. 2 is a perspective view of the support in FIG. 1 in collapsed, deflated configuration.

FIG. 2 illustrates the support of FIG. 1 in its deflated state. End portions 3 are folded over to be substantially parallel with top portion 2*a* and bottom portion 2*b*. Top portion 2a is laid directly on bottom portion 2*b*.

Figure 3:
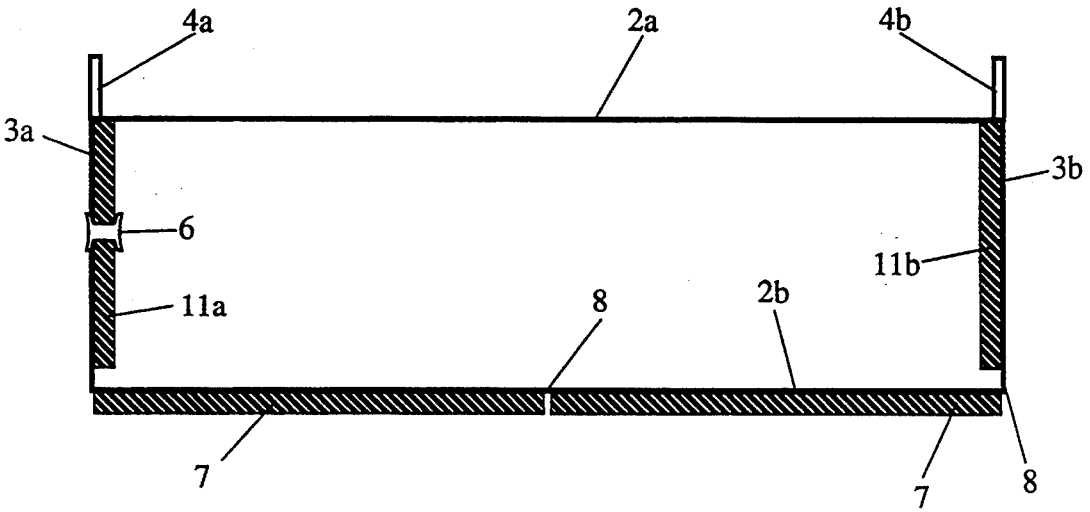
FIG. 3 is a longitudinal cross-section of the support in FIG. 1 along the line 3'—3'.

FIG. 3 shows a cross-section of the support of FIG. 1 from end to end, along the line 3'—3'. FIG. 3 shows rigid or stiff end members 11*a* and 11*b* lining end portions 3*a* and 3*b* respectively. Rigid end members stiffen end portions 3. In the preferred embodiment, the stiffening of end portions 3 is achieved by attaching separate, rigid end members 11. However, end portions 3 may be made of an inherently rigid material. In FIG. 3, end portions 3 are assumed to be flexible since rigid end members 11 are present.

Figure 4:
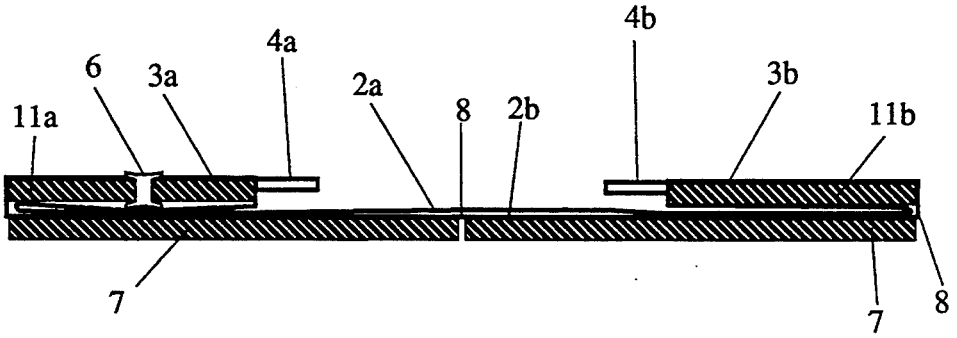
FIG. 4 is a longitudinal cross-section of the collapsed support in FIG. 2 along the line 4'—4'.
Figure 5:
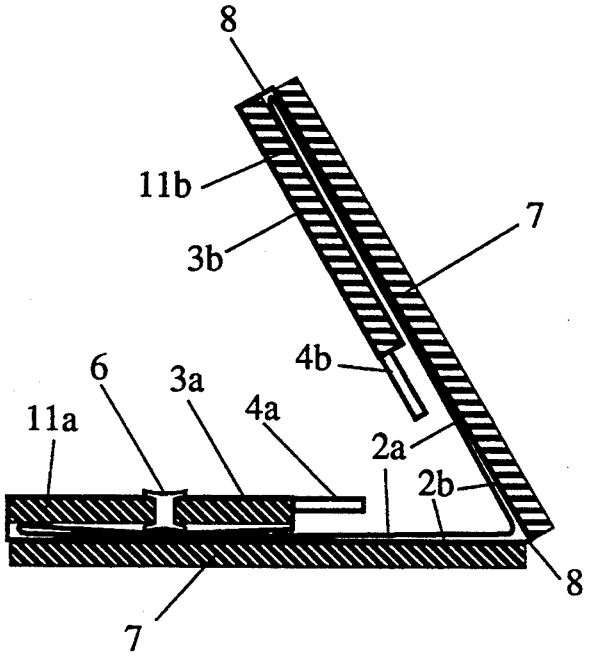
FIG. 5 is the longitudinal cross-section of FIG. 4 with rigid base members partially folded over.

In a further embodiment of the invention, bottom portion 2*b* can include a plurality of rigid or stiff base members 7. FIG. 3, FIG. 4, and FIG. 5 show bottom portion 2*b* having two stiff, base members 7. Stiff base members 7 are attached to bottom portion 2*b*. They are separated from one another via flexible seam 8. Stiff base members 7 and stiff end members 11 could be comprised of the same relatively rigid material.

Each stiffened end portion 3 and its respective base member 7 are in hinge-like relation via another flexible seam 8. FIG. 4 is a cross-section of the support of FIG. 2 from end to end, along the line 4'—4'. The drawing shows how stiffened, end portions 3 are folded over at flexible seams 8. FIG. 4 depicts end portions 3 in parallel relation with the plane of bottom portion 2*b*.

Flexible seam 8 will usually be made of the same air-impervious material as longitudinal portion 1 and end portions 3. Flexible seam 8 must be flexible enough to allow sufficient hinge-like action between its stiff, connected members.

FIG. 5 depicts the cross-section of FIG. 4 with bottom portion 2*b* partially folded. Folding occurs at flexible seam 8 between stiff base members 7.

Figure 6:
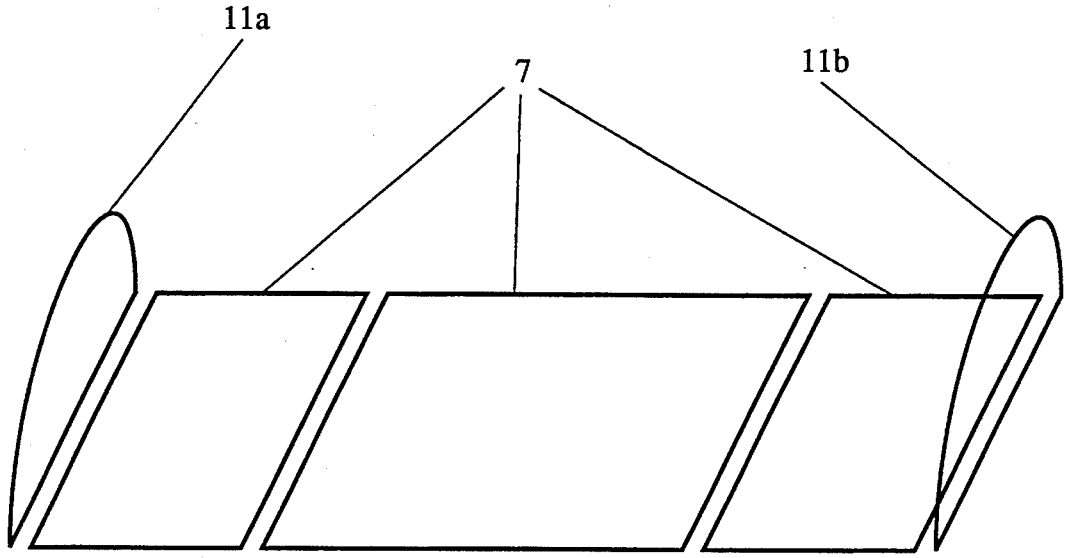
FIG. 6 is a perspective view of a wire frame to be used to stiffen the end portions and base portion of a support.

In another further embodiment of the invention, the edges of end portions 3 can be framed. Wire or other suitable material may be used. Bottom portion 2*b* can be framed in a similar manner. FIG. 6 illustrates a wire frame consisting of three base members 7, and two end members 11*a* and 11*b*. In FIG. 6, the wire frame is suspended in an erect configuration.

In different embodiments of the invention, end portions 3 can be a variety of shapes and sizes. The top edge of end member 3 may have an arc of varying size and curvature. The goal is to form shapes that lose significant volume when flattened or deformed. The reasoning behind this will be discussed in the Theory of Operation section.

Figure 7:
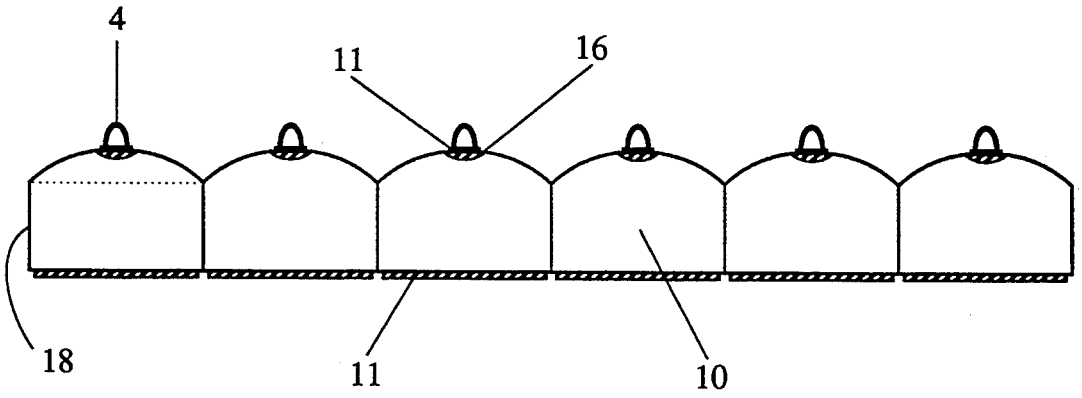
FIG. 7 is an end view of a multi-chamber embodiment having end portions shaped as arcs with rectangular foundations and having end pockets for holding independent, rigid end members.

FIG. 7 is an end view of a multi-unit embodiment. This drawing shows that a pocket 10, can be attached to end portions 3. An independent, rigid end member 11 is inserted into pocket 10. In the preferred embodiment, independent, rigid end member 11 is inserted from the bottom.

In another further embodiment of the invention, each pocket 10 can have a pocket hole 16. FIG. 7 shows pocket holes 16 at the upper edges of end portions 3. Furthermore, erecting mechanisms 4 are attached to independent, end members 11. Erecting mechanisms 4 are positioned on end members 11 to slip through pocket holes 16.

In another further embodiment of the invention, an adhesive such as Velcro may be attached to the base of the support. This would allow the support to be mounted on a surface. For example, adhesive could be used to adhere an automatically inflating, lumbar rest to a chair.

Figure 8:
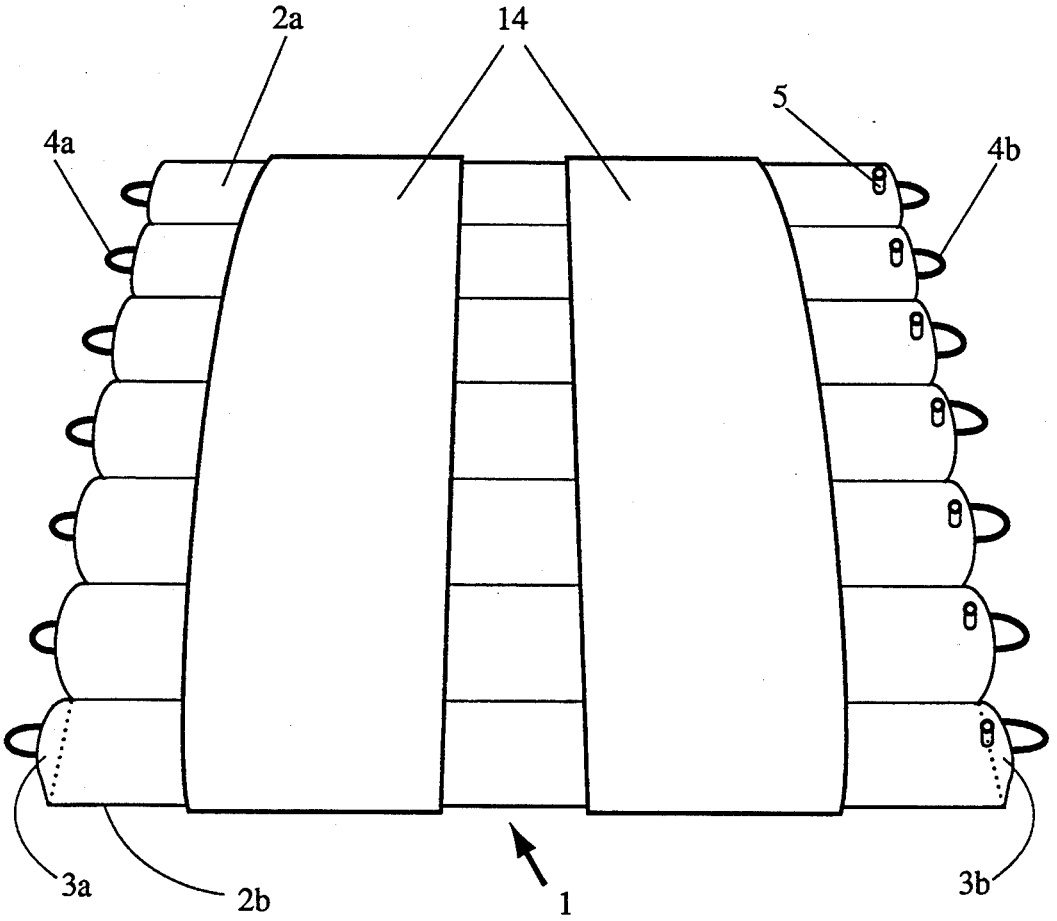
FIG. 8 is a perspective view of a multi-chamber embodiment, showing straps unifying the individual chambers.
Figure 9:
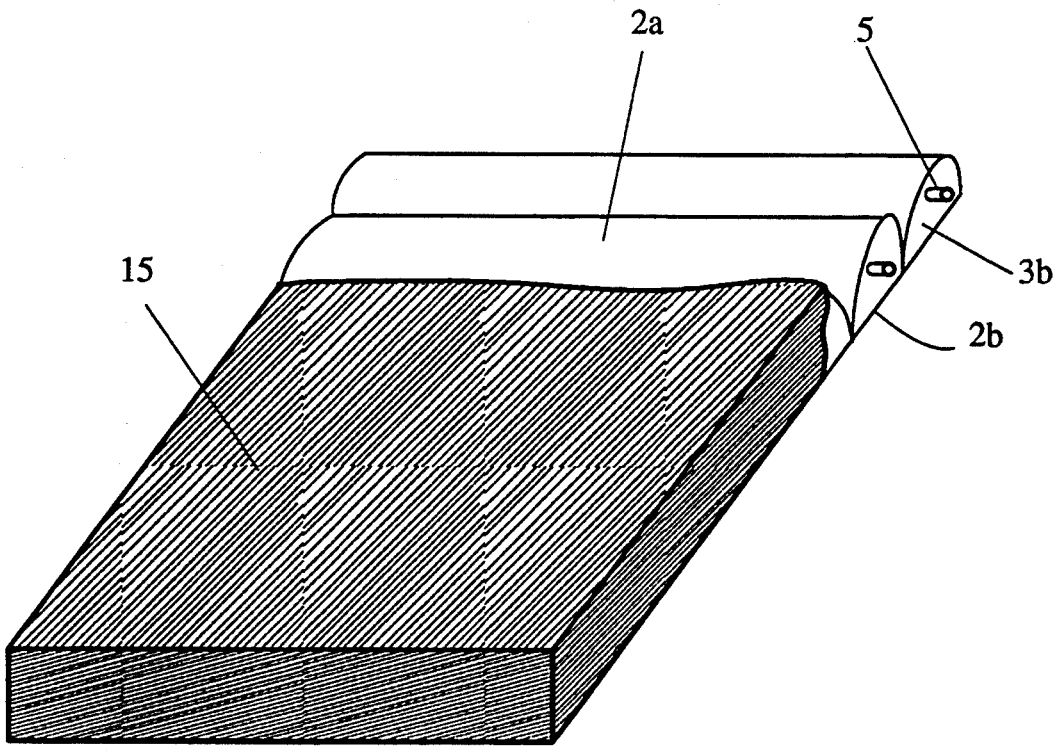
FIG. 9 is a cutaway view of a multi-chamber embodiment being covered by a jacket.

FIG. 8 and FIG. 9 also show multi-chamber embodiments. In multi-unit embodiments, individual chambers are juxtaposed along their longitudinal edges. In other words, the chambers are positioned so that longitudinal portions lie side by side. The individual chambers may be in this position simply by placement. On the other hand, the chambers may be connected by a seam. Although they could transfer inflating fluid, the chambers should usually be separate.

In FIG. 7 end portions 3 have the shape of an arc with a rectangular foundation 18. This shape may better serve multi-unit applications, such as mattresses. The rectangular foundation 18 fills part of the gap between chambers.

FIG. 8 is a perspective view illustrating straps 14. Straps 14 partially encase the multi-chamber support. FIG. 9 shows a similar embodiment. FIG. 9 is a cutaway perspective view of an air mattress. FIG. 9 shows a jacket 15 encasing the multi-chamber embodiment. Jacket 15 is partially removed to expose some individual chambers.

Jacket 14 or strap 15 can cover any automatically inflating supports. These coverings will usually be made of relatively inelastic, flexible material.

It will be appreciated that various materials can be employed in the structure of the invention. For the chamber as a whole, air-imperviousness is essential. Longitudinal portion 1 must comprise flexible materials. Also, the materials used should be appropriately inelastic. End members 11 and base member(s) 7 should be made of relatively stiff material.

The support can have added materials to achieve various properties. For example, it may be desirable to provide a soft fabric covering. Another possibility is to add a gripping layer to bottom portion 2*b*. Similarly, the support may be treated to achieve various properties. For instance, the support may be flocked.

Figure 10:
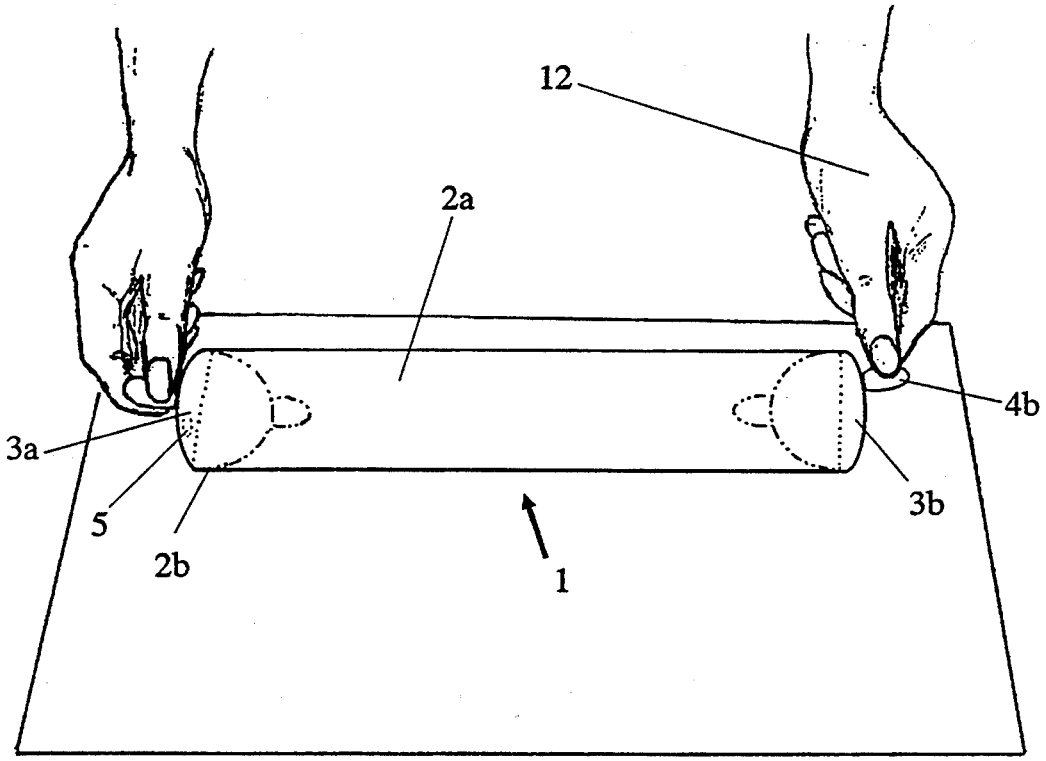
FIG. 10 is a perspective illustration of hands erecting a single chamber embodiment from its flat, deflated configuration to its erect, inflated configuration.
Figure 11:
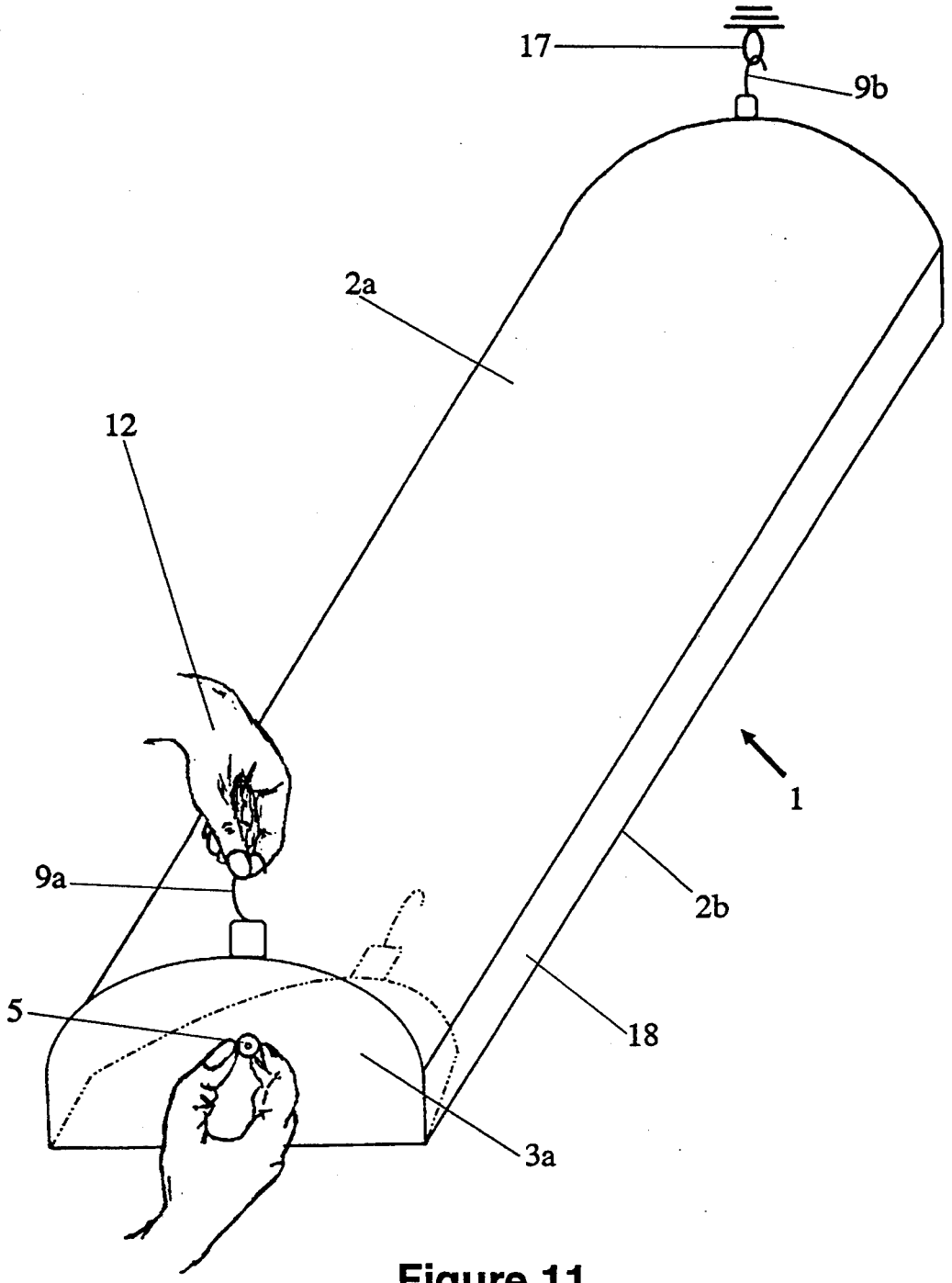
FIG. 11 is a perspective illustration of erecting a chamber with one hand by using a hook attached to a fixture on one end-portion, leaving the second hand free to close the two way valve.

FIG. 10 and FIG. 11 are perspective views showing the automatic inflating system in action. In these drawings hands 12 perform the inflating action. The inflating operation is described more fully in the next section. The support of FIG. 10 is sized to be a wrist-rest for a small, portable computer.

FIG. 11 shows another modification to the auto-inflating. In FIG. 11, attaching mechanisms 9 are mounted on end portions 3. Attaching mechanisms 9 can be, for example, simple hooks. Attaching mechanisms 9 are designed to attach to attachment fixtures 17. Attachment fixtures 17 can be, for example, simple rings.

Observe that attaching mechanism 9 can replace erecting mechanism 4. This is portrayed in FIG. 11. It also should be noted that erecting mechanisms 4 are optional. Thus some embodiments of my automatically inflating supports will not include such parts.

Other modifications and variations both in the configuration and in the materials employed will, however, be apparent to those of ordinary skill in the art and are considered to be within the scope of the present invention as defined by the claims appended hereto.

OPERATION OF INVENTION

FIG. 10 illustrates the erecting and inflating of the present invention. This paragraph describes the general manipulation involved in erecting and inflating the supports of the present invention. As illustrated in FIG. 10, two pull tabs 4 are grasped. They are pulled outward and upward. This moves end portions 3 and the rest of the airtight chamber into an erect configuration. Open/-close valve 5 has been set to its open state. Therefore, as the support enters its erect configuration, air is drawn into the airtight chamber. Closing valve 5 completes the inflating process.

When the support is used, it flattens and decreases in volume. Simultaneously, the support's internal air pressure increases. This internal pressure gives the support its capacity to bear weight. The airtight, hollow body must not be able to stretch excessively under a load. Otherwise, the volume will not decrease much and the weight supporting capacity will be reduced. This is why it is important that the airtight chamber be relatively inelastic.

As shown in FIG. 10, hands may perform the grasping and erecting actions. Erecting mechanisms 4 facilitate moving the support to an erect, inflated configuration. If they were absent, however, then stiffened, end portions 3 could be grasped.

End portions 3 need only be sufficiently stiff to erect and inflate the support. Stiff, end members 11 can effectuate this stiffness. Rigid base members 7 can also help maintain the desired shape as the embodiment is erected and inflated.

End pockets 10 and independent, rigid end members 11 have certain advantages. Independent, rigid end members 11, as shown in FIG. 7, are readily replaceable if damaged. Independent, end members 11 also can enable the supports to be more comfortable. Upon completion of the inflating process, stiff end members 11 can be removed. Then, the user would not be at risk of being discomforted by these rigid parts.

In a multi chamber embodiment, end pockets 10 can provide another benefit. Only one pair of independent, stiff end members 11 is necessary. In this case, a person would move rigid end members 11 from trait to unit. The chambers would be inflated one at a time.

Rigid base members 7 would be useful in portable applications, where a flat, hard surface is not always available (e.g., a portable wrist rest for a laptop computer). The multi-piece base can be folded over in its collapsed configuration to provide a more compact structure than that of a single piece base.

In the two valve configuration of FIG. 1, open/close valve 5 serves as an outlet valve. One-way valve 6 serves as the intake valve. In the two valve embodiment, valve 5 is closed during inflating. It is only opened when deflating the support. Inflating air enters one-way valve 6.

The chamber is deflated by first opening valve 5. Then end portions 3 are folded downward. Similarly, top portion 2a and bottom portion 2b are collapsed together. This results in all portions of the support essentially lying in a plane.

A gripping layer at bottom portion 2b can prevent the supports from sliding or shifting. Added fabrics can make the supports more comfortable by providing a soft surface. Straps 14 or jackets 15 can make the airtight, hollow bodies less elastic.

Jackets 15 or straps 14 are especially useful in multi-chamber embodiments. In multi-chamber embodiments, they can help contain and unify the individual chambers. Also, a covering like jacket 15 can help distribute weight over the surface of a multi-unit embodiment to assure adequate support.

FIG. 11 illustrates the one-hand erecting technique described in this paragraph. First, one end of the support is erected. This is accomplished by securing attaching mechanism 9 to attachment fixture 17. Using one hand to pull the other attaching mechanism outward, air is drawn into the hollow body. The second hand is available to close valve 5, and to thus trap the inflating air.

A benefit of having the free hand is the ability to close open/close valve 5 without letting go of one end. Also, end members 3 may be too far apart to grasp both ends simultaneously. Attaching mechanism 9 could allow a person to erect and inflate such an embodiment.

THEORY OF OPERATION

The theory behind geometrically efficient shapes is discussed in this section. The discussion justifies the shapes covered under the disclosed auto-inflating cushion.

Symbol Definitions

The following symbols are used in the calculations and illustrations of geometric efficiencies. The reader should use this list for reference.

$\lambda$=A transverse, vertical cross-section 20's surface area divided by its corresponding rectangle 22's surface area. Corresponding rectangle 22 is the rectangle with equal perimeter and equal width, where width is defined as the shape's biggest dimension.

A=Area of transverse, vertical, cross-section 20.

$A_r$=Area of corresponding rectangle 22.

W=Width of vertical cross-section 20 and, by definition, width of corresponding rectangle 22.

$h_r$=Height of corresponding rectangle 22.

P=Perimeter of transverse, vertical cross-section 20, and by definition, perimeter of corresponding rectangle 22.

R=Radius of circle.

$A_t$=Where applicable, the area of the triangle formed by the line segment connecting a circular arc's endpoints and the radii to the arc's endpoints.

$A_s=A+A_t$ where applicable.

$h_t$=Height of above described triangle.

$b_t$=Base of above described triangle.

$A_f$=Area of cross-section of rectangular foundation.

A'=Initial area of cross section of composite shape's geometrically efficient portion. By definition: $A'=A-A_f$.

A″=Area of cross section of composite shape's geometrically efficient portion in deformed configuration. By definition: $A''=A_r-A_f$.

h=Height of vertical cross-section 20 excluding height of rectangular foundation.

$h_f$=Height of rectangular foundation.

$b_f$=Base of rectangular foundation.

Comparison of Semi-cylinder to Rectangular Parallelepiped

The quantitative analysis below approximates the change in volume that occurs when a semi-cylinder deforms into a rectangular parallelepiped. To simplify the calculations and drawings, the analysis compares the areas of transverse, vertical, cross-sections instead of volumes. The cross-section of a semi-cylinder is a semicircle, and the cross-section of a rectangular parallelepiped is a rectangle. Using areas of cross-sections is permissible. This is because the volumes are approximately these areas multiplied by the span of the geometric shapes. This factor would drop out of the final equation.

Figure 12:
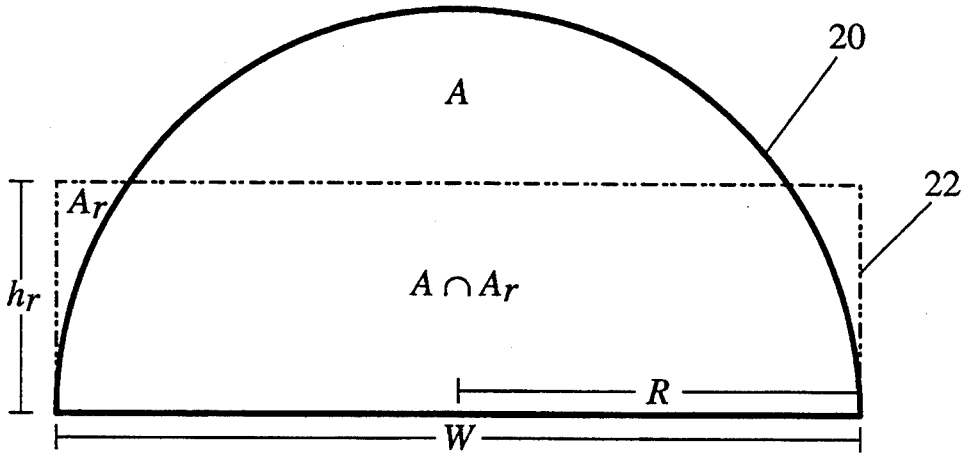
FIGS. 12–15 are transverse, cross-sectional views illustrating theoretical analyses of the supports of this invention.

Refer to FIG. 12 for a graphical presentation. A transverse, vertical cross-section 20 is shown. Transverse vertical cross-section 20 forms a semi-circle. A corresponding rectangle 22 is also shown. The phantom lines indicate that vertical cross-section 20 flattens into corresponding rectangle 22. Corresponding rectangle 22 is formed by reshaping the semicircle's are into three sides of the rectangle and having the base of the semicircle as the fourth side.

$$\text{Clearly, } A = \frac{1}{2}\,(\text{Area of circle}) = \frac{1}{2}\,\pi R^2 = R^2\frac{\pi}{2}\quad W = 2R$$

$$P = \text{Perimeter of semicircle} = \frac{1}{2}\,(\text{Perimeter of circle}) +$$

$$W = \frac{1}{2}\,2\pi R + 2R = \pi R + 2R$$

$$P = \text{Perimeter of corresponding rectangle} = 2h_r + 2W = 2h_r + 4R$$

equating these expressions for $P$, $$\pi R + 2R = 2h_r + 4R \rightarrow h_r = R\left(\frac{\pi}{2} - 1\right)$$

$$\text{Clearly, } A_r = Wh_r = 2RR\left(\frac{\pi}{2} - 1\right) = R^2(\pi - 2)$$

$$\lambda = \frac{A}{A_r} = \frac{R^2\frac{\pi}{2}}{R^2(\pi - 2)} \approx 1.376$$

CONCLUSION

A semi-cylinder has approximately 37.6% more volume than the rectangular parallelepiped that it would deform into, assuming no stretching of materials. Note that R drops out of the final equation which means that this analysis is independent of scale.

FIG. 12 is drawn to scale. The perimeter of vertical cross-section 20 and the perimeter of corresponding rectangle 22 are equal in FIG. 12. The fact that A is greater in surface area than $A_r$ creates the optical illusion that the perimeter of cross-section 20 is greater than the perimeter of corresponding rectangle 22. The optical illusion occurs particularly when a person imagines deforming vertical cross-section 20 into corresponding rectangle 22. The optical illusion generally does not occur when a person imagines deforming corresponding rectangle 22 into vertical cross-section 20.

Comparison of 90° Arch to Rectangular Parallelepiped

Here, the change in volume is estimated when the 90° arch is deformed into an approximately rectangular box. The analysis below is closely analogous to that for the semi-cylinder above. Again, cross sectional areas are compared in lieu of volumes.

Figure 13:
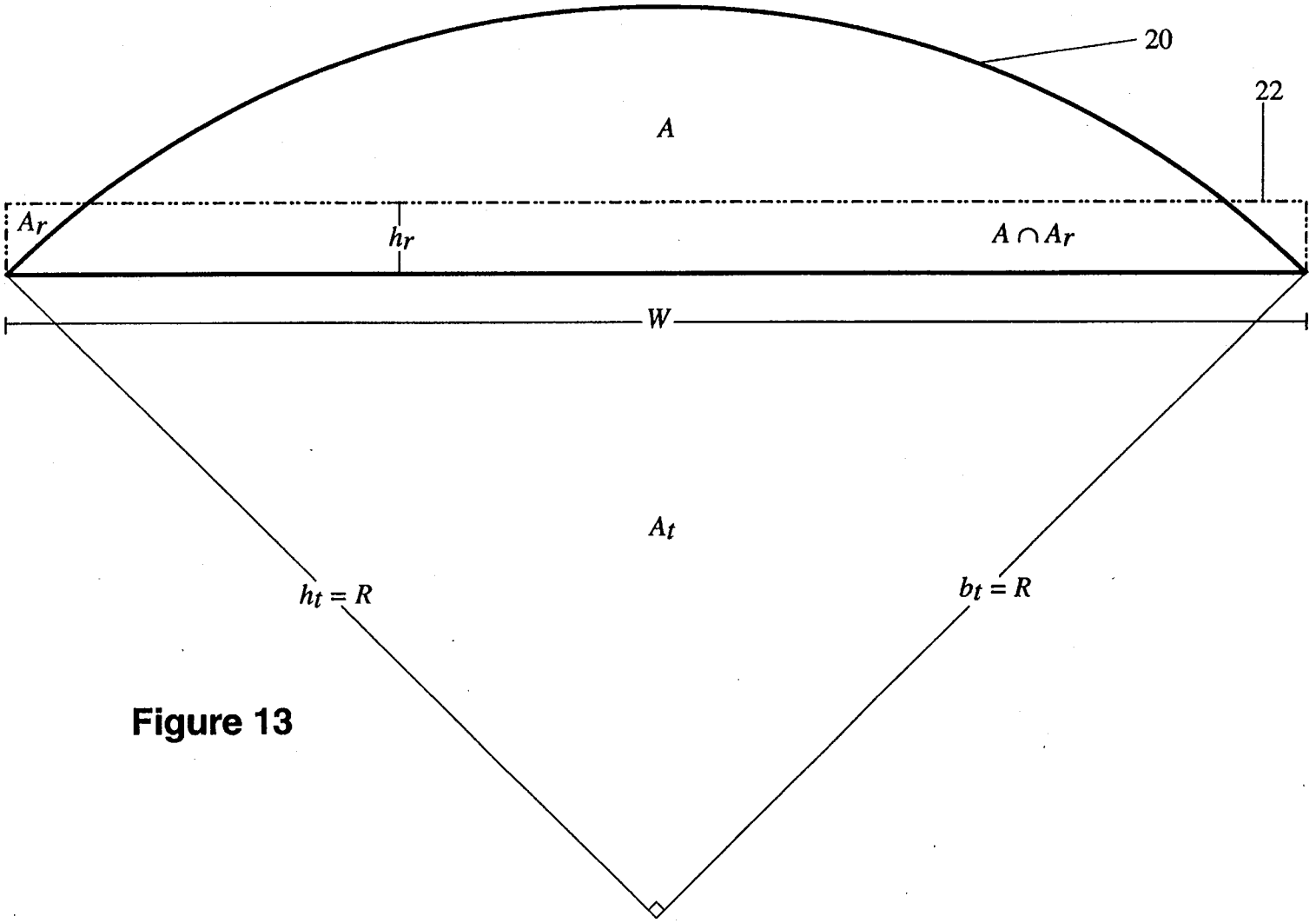

Refer to FIG. 13 for a graphical presentation. This drawing shows what happens to the area of vertical cross-section 20 when deformed into corresponding rectangle 22.

$$\text{Clearly, } h_t = b_t = R\quad W = R\sqrt{2} \text{ because isosceles right triangle}$$

$$A_t = \frac{b_t h_t}{2} = \frac{R^2}{2}\quad A_S = \frac{1}{4}\,(\text{Area of circle}) = \frac{1}{4}\,\pi R^2$$

$$A = A_S - A_t = \frac{1}{4}\,\pi R^2 - \frac{R^2}{2} = R^2\left(\frac{\pi}{4} - \frac{1}{2}\right)$$

$$P = \text{Perimeter of shape} = \frac{1}{4}\,(\text{Perimeter of circle}) +$$

$$W = \frac{1}{4}\,2\pi R + R\sqrt{2} = \frac{\pi}{2}R + R\sqrt{2}$$

equating expressions for $P$, $$\frac{\pi}{2}R + R\sqrt{2} = 2h_r + 2R\sqrt{2} \rightarrow h_r = R\left(\frac{\pi}{4} - \frac{\sqrt{2}}{2}\right)$$

$$\text{Clearly, } A_r = Wh_r = R^2\left(\pi\frac{\sqrt{2}}{4} - 1\right)$$

$$\lambda = \frac{A}{A_r} = \frac{R^2\left(\frac{\pi}{4} - \frac{1}{2}\right)}{R^2\left(\pi\frac{\sqrt{2}}{4} - 1\right)} \approx 2.58$$

CONCLUSION

A support shaped as a 90° arch has approximately two and a half times the volume that it has when deformed into a rectangular parallelepiped-approximately 150% more volume.

Again, R drops out of the final equation which means that this analysis is independent of scale. FIG. 13, which is drawn to scale, shows the large difference in areas. The optical illusion is even more apparent in FIG. 13.

Comparison of 60° Arch to Rectangular Parallelepiped

Here, the change in volume is calculated when the curved portion of a 60° arch is deformed into the three completing sides of a rectangular parallelepiped. The analysis below is closely analogous to the previous analyses. Again, cross sectional areas are compared instead of volumes.

Figure 14:
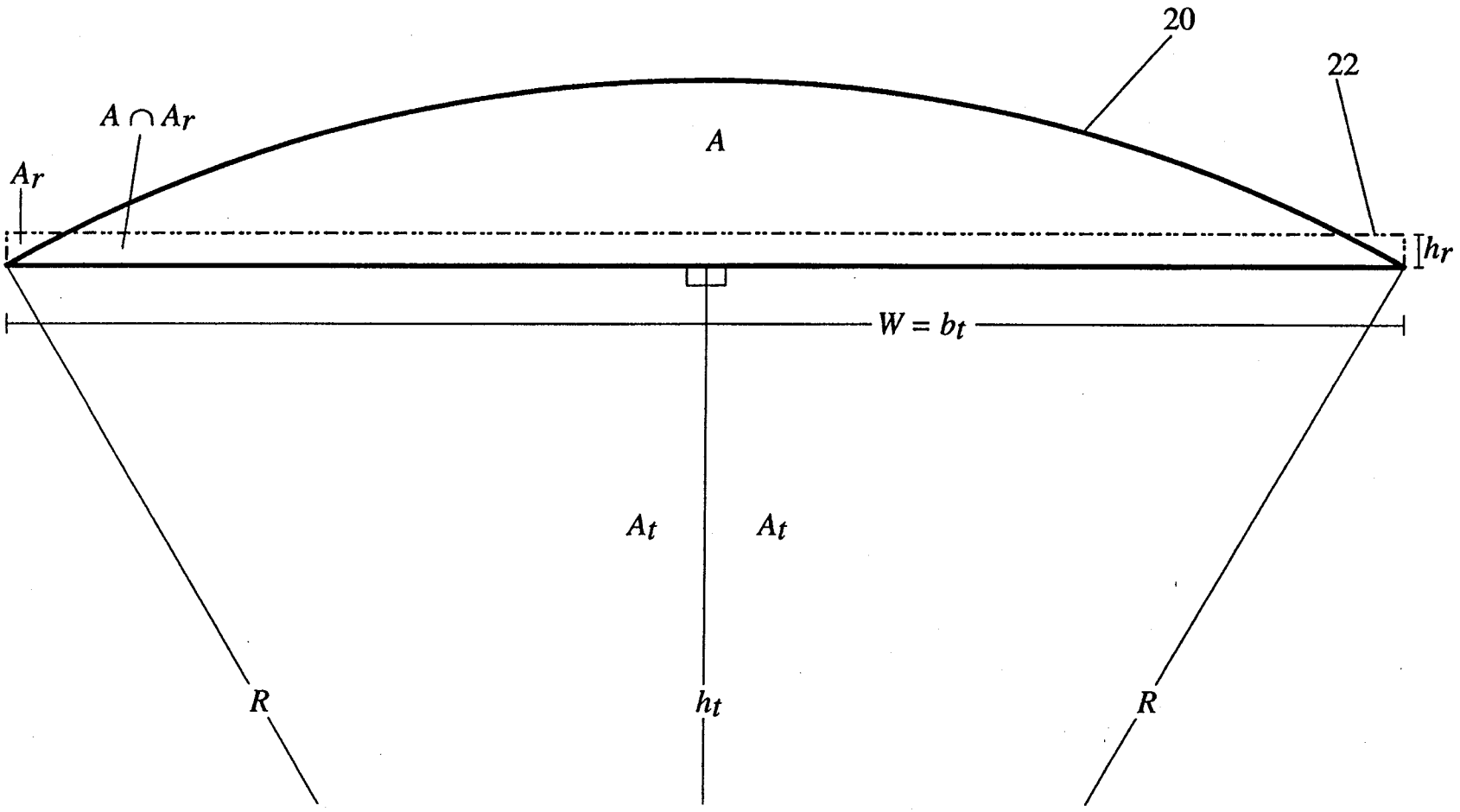

Refer to FIG. 14 for a graphical presentation. This drawing again shows vertical cross-section 20 and corresponding rectangle 22. Vertical cross-section 20 deforms into corresponding rectangle 22 as indicated by the phantom lines. Note that the lines pointing off the page converge at the vertex of the circle.

$W = b_t = R$ because equilateral triangle $h_t =$ $$R\frac{\sqrt{3}}{2} \text{ from geometry}$$

$$A_t = \frac{b_t h_t}{2} = R^2\frac{\sqrt{3}}{4} \quad A_S = \frac{1}{6}\text{(Area of circle)} = \frac{\pi R^2}{6}$$

$$A = A_S - A_t = \frac{\pi R^2}{6} - R^2\frac{\sqrt{3}}{4} = R^2\left(\frac{\pi}{6} - \frac{\sqrt{3}}{4}\right)$$

$P =$ Perimeter of shape $= \frac{1}{6}$ (Perimeter of circle) $+ W =$ $$\frac{2\pi R}{6} + R = \frac{\pi}{3}R + R$$

$P =$ Perimeter of corresponding rectangle $=$ $$2h_r + 2W = 2h_r + 2R$$

equating expressions for $P$, $\frac{\pi}{3}R + R = 2h_r +$ $$2R \rightarrow h_r = R\left(\frac{\pi}{6} - \frac{1}{2}\right)$$

Clearly, $A_r = Wh_r = R^2\left(\frac{\pi}{6} - \frac{1}{2}\right)$ $$\lambda = \frac{A}{A_r} = \frac{R^2\left(\frac{\pi}{6} - \frac{\sqrt{3}}{4}\right)}{R^2\left(\frac{\pi}{6} - \frac{1}{2}\right)} \approx 3.84$$

CONCLUSION

A 60° arch has well over three and a half times the volume that it has when the curved portion is deformed into a rectangular box-approximately 284% more fluid.

Again, R drops out of the final equation which means that this analysis is independent of scale. FIG. 14, which is drawn to scale, shows the dramatic difference in the areas. The optical illusion is extremely apparent in FIG. 14.

Figure 15:
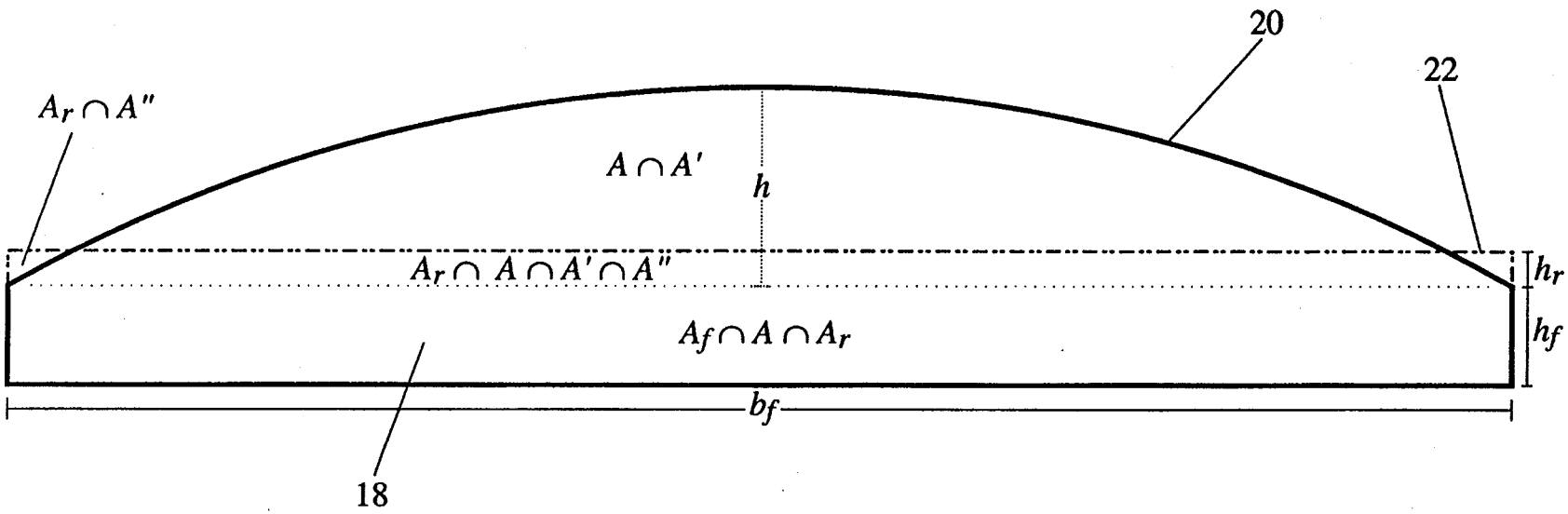

Comparison of 60° Arch with Rectangular Parallelepiped Foundation to Rectangular Parallelepiped The analysis shown below is a continuation of the analysis comparing an arch of 60° with a rectangular parallelepiped. Refer to FIG. 15 for a graphical presentation. Here, a rectangular parallelepiped is added to the bottom of a 60° arch. Such a composite shape would be appropriate when multiple inflating units are positioned side by side in, for example, an air mattress. A rectangular foundation would serve to fill gaps between inflating units. Again, cross-sectional areas are compared in lieu of volumes to approximate the change in volume.

Note that it is reasonable to estimate that the initial composite shape would deform into a rectangular parallelepiped. This is especially true when multiple inflatable units are laid side by side.

NOTE

This analysis refers to information found in the previous subsection and FIG. 14. Here, the previous analysis' A becomes A′ and the previous analysis' $A_r$ becomes A″:

By definition, $W = b_f = R$ Clearly, $h = R - h_t =$ $$R - R\frac{\sqrt{3}}{2} = R\left(1 - \frac{\sqrt{3}}{2}\right)$$

$h_f$ is an engineering decision that can be arbitrarily set to:

$$\frac{h}{2} = R\left(\frac{1}{2} - \frac{\sqrt{3}}{4}\right)$$

Clearly, $A_f = b_f h_f = R^2\left(\frac{1}{2} - \frac{\sqrt{3}}{4}\right)$ $$A' = A' + A_f = R^2\left(\frac{\pi}{6} - \frac{\sqrt{3}}{4} + \frac{1}{2} - \frac{\sqrt{3}}{4}\right) = R^2\left(\frac{\pi}{6} + \frac{1}{2} - \frac{\sqrt{3}}{2}\right)$$

$$A_r = A'' + Af = R^2\left(\frac{\pi}{6} - \frac{1}{2} + \frac{1}{2} - \frac{\sqrt{3}}{4}\right) = R^2\left(\frac{\pi}{6} - \frac{\sqrt{3}}{4}\right)$$

$$\lambda = \frac{A'}{A_r} = \frac{R^2\left(\frac{\pi}{6} + \frac{1}{2} - \frac{\sqrt{3}}{2}\right)}{R^2\left(\frac{\pi}{6} - \frac{\sqrt{3}}{4}\right)} \sim 1.74$$

CONCLUSION

When choosing $h_f = h \div 2$ this composite shape still has almost 75% more area than its corresponding rectangle. Adding a rectangular foundation to the bottom of a 60° arch "dilutes" the efficiency of the arch. In this analysis, the same difference in area, $A - A_r = A' - A''$, is simply being compared to a larger area, $A_r$ instead of A″. Such a composite shape would be most often used in multi-unit applications. This is because the inflating chambers could abut without intervening gaps.

It is interesting that $A_r = A'$ in the above analysis. Again, R drops out of the final equation which means that this analysis is independent of scale. FIG. 15 is a proportionate graphic representation of this analysis.

Volume Factors and Weight Supporting Capacity

Below, I analyze the weight bearing capacity of the auto-inflating cushion. The analysis shows how volume, pressure, and support surface areas relate to weight support capacity. This section calculates how effective the automatically inflating supports can be. The discussion below explains how much weight can be supported as volume in a chamber diminishes and as weight is distributed over surface area. Because this question has many variables, it is difficult to provide exact numerical results. Therefore, the analysis will instead provide ranges of results.

V = Initial volume of inflating chamber.

$\mu$=Volume factor the number of times initial volume is greater than deformed volume. This is the quantity that $\lambda$ approximates.

Q=Atmospheric pressure. The pressure outside the chamber. The pressure inside the chamber before it is deformed.

Q'=Pressure inside chamber after chamber is deformed.

$A_F$=Horizontal surface area over which force or weight is distributed.

F=Force or weight that can be supported given all other information.

$$QV = Q'\frac{V}{\mu} \rightarrow Q' = \mu Q$$

This is true because pressure times volume is constant inside a fluid chamber, assuming no change in temperature and amount of fluid. As volume decreases pressure proportionately increases.

From physics, $F=(Q'-Q)A_F$

This equation says that the difference in pressure inside and outside a chamber multiplied by the horizontal area of contact equals the weight that can be supported.

Substituting, $F=(\mu Q-Q)A_F=Q(\mu-1)A_F$

NOTE

See the Support Capacity Table listing values of F for various $\mu$'s and $A_F$'s.

CONCLUSION

The results show that the weight supporting capacity of the inflating system presented can be very substantial. A particular application will dictate what shape and geometry is most suitable. The shapes presented here or minor variations of these shapes should be adequate to satisfy most applications. In practice, designs should be over-engineered since fluid can easily be expelled from a chamber if over-inflating occurs. Also, since weight supporting capacity is proportional to atmospheric pressure, designs involving air should be over-engineered to ensure proper functioning at high altitudes.

Support Capacity Table

The table below shows weights that can be supported given various supporting surface areas and various volume factors. The units of $A_F$ are given in square inches. The weights, the values inside the table, are in pounds. These are calculated by applying the formula: $F=Q(\mu-1)A_F$. In this table Q is assumed to be 14.7 lbs/in$^2$.

Issues that Affect Results

The analyses presented must not be construed too strictly. This section highlights the analytical assumptions that will vary in practice.

This paragraph discusses the assumptions that relate to the shape of an inflatable unit. First, in practice the erecting/inflating action will not form perfect initial shapes (e.g., semi-cylinders, 60° arches, . . .). However, if an inflating chamber is constructed without slack material, the shapes can be very close approximations. Second, it is obvious that the initial shapes would not deform exactly into rectangular parallelepipeds. In truth, a particular shape would barely deform at all very near its ends if these are supported by rigid end pieces. On the other hand, depending upon the weight and geometry of that which is being supported, other sections of the support would likely deform into shapes even less efficient than rectangles. The rectangular parallelepiped is useful as an average shape that is simple to analyze. Also, the rectangular parallelpiped is useful in comparing the prior art. However, more sophisticated analyses can be conducted by applying curve fitting techniques and calculus.

This paragraph discusses issues that relate to pressure and weight supporting capacity. Note that this discussion is closely related to the discussion about shapes because shape affects volume which in turn affects pressure. First, atmospheric pressure is assumed to be 14.7 lbs/in$^2$. This factor varies slightly from day to day along with changes in weather. More importantly, this factor will be noticeably lower at high altitudes. Second, it is usually difficult to predict exactly how a supported weight would rest upon a cushion; in other words, $A_w$ is an unknown variable parameter. If a weight is spread over a large surface area it should be well supported. If the same weight is concentrated on a small spot, the inflating system may not support it. For most applications it is a matter of selecting the right geometry to get adequate support. However, in some applications an intervening layer that spreads the weight may be desirable or necessary. For example, a flat plate could be positioned between an inflatable packing cushion and cargo to spread the weight.

Other simplifying assumptions have also been made. For example, it is assumed that the chamber itself has no weight. However, these other considerations are generally negligible. The presented analysis provides a skilled person sufficient information to apply the inflating system.

SUMMARY, RAMIFICATIONS, AND SCOPE

It can be seen that the automatic inflating system presented here provides an effective means to fill a wide range of inflatable supports. This system has many ad-

| | $\mu$ | | | | | | | | |
|---|---|---|---|---|---|---|---|---|---|
| $A_F$ | 1.25 | 1.376 | 1.5 | 1.74 | 2 | 2.58 | 3 | 3.84 | 5 |
| 1 | 3.68 | 5.53 | 7.35 | 10.88 | 14.70 | 23.23 | 29.40 | 41.75 | 58.80 |
| 4 | 14.70 | 22.11 | 29.40 | 43.51 | 58.80 | 92.90 | 118 | 167 | 235 |
| 9 | 33.08 | 49.74 | 66.15 | 97.90 | 132 | 209 | 265 | 376 | 529 |
| 36 | 132 | 199 | 265 | 392 | 529 | 836 | 1,058 | 1,503 | 2,117 |
| 81 | 298 | 448 | 595 | 881 | 1,191 | 1,881 | 2,381 | 3,382 | 4,763 |
| 144 | 529 | 796 | 1,058 | 1,566 | 2,117 | 3,345 | 4,234 | 6,012 | 8,467 |
| 216 | 794 | 1,194 | 1,588 | 2,350 | 3,175 | 5,017 | 6,350 | 9,018 | 12,701 |
| 288 | 1,058 | 1,592 | 2,117 | 3,133 | 4,234 | 6,689 | 8,467 | 12,023 | 16,934 |
| 432 | 1,588 | 2,388 | 3,175 | 4,699 | 6,350 | 10,034 | 12,701 | 18,035 | 25,402 |
| 720 | 2,646 | 3,980 | 5,292 | 7,832 | 10,584 | 16,723 | 21,168 | 30,059 | 42,336 |

vantages over the prior art. Conventional prior art relies on unhygienic blow-up valves or cumbersome pumps. Prior art relating to automatic inflating systems has concentrated on relatively inefficient geometry. By producing geometrically efficient volumes, this system achieves greater weight support capacities. There are many benefits to using this system, such as:

- sufficient inflating to provide adequate support;
- cushions that are soft, pleasant, and unobstructed;
- conformation to contours of that which is being supported;
- ease of operation;
- portability;
- provision for articles that are versatile and appropriate in shape;
- adjustability
- inexpensive and long lasting.

Although the description above contains many specificities, these should not be construed as limiting the scope of the invention but as merely providing illustrations of some of the presently preferred embodiments of this invention. For example, one-way valve 6 and open/close valve 5 could be combined into a single valve, the dual function being activated by a switch. Different valve systems can be selected based on consideration of individual applications. A single piece base might be more appropriate than a multi-membered base. Machines or mechanical devices can perform the erecting and inflating action. An additional pump or other inflating system may be provided to supplement the inflating system. Finally, additional uses could include use of these hollow bodies as packing material. By placing a flat, rigid plate on top of the hollow body (bodies), the weight of the applied load will be evenly distributed over the area of the hollow body. Air is expected to be the inflating fluid, but other fluids may be used.

Thus the scope of the invention should be determined by the appended claims and their legal equivalents, rather than by the examples given.

Having thus described my invention, I claim:

1. A substantially supportive cushion comprising:

a) a substantially airtight hollow body comprising:

i) a pair of end portions(3), made of substantially air impervious material, said end portions(3) being substantially opposed when in an erect configuration;

ii) a longitudinal portion(1), made of substantially air impervious material, a portion of which is flexible, said longitudinal portion interconnected to the end portions(3) around the edges of the end portions(3) and forming said substantially airtight hollow body with the end portions(3), said longitudinal portion(1) and said pair of end portions(3) shaped such that when the end portions(3) are opposed in said erect configuration, a transverse, vertical cross-section(20) of said longitudinal portion(1) has a surface area at least 1.3 times greater than the surface area of its corresponding rectangle(22), where the corresponding rectangle(22) is the rectangle with equal perimeter and equal width, where width is defined as the cross-section(20)'s biggest dimension;

b) a means to stiffen the end portions(3), whereby a means to move the end portions(3) into said erect configuration will ordinarily be available prior to use;

c) a valvular means(5) that controls the flow of air between the interior and exterior of said substantially airtight hollow body, such that moving the end portions(3) into said erect configuration causes a surrounding atmospheric pressure to inflate said substantially airtight hollow body, but such that air is prevented from escaping said substantially airtight hollow body during use of the cushion.

2. The cushion of claim 1 wherein the vertical cross-section(20) has a surface area at least 1.5 times the corresponding rectangle(22)'s surface area, but wherein the cross-section(20) has a surface area less than 1.75 times the corresponding rectangle(22)'s surface area.

3. The cushion of claim 1 wherein the vertical cross-section(20) has a surface area at least 1.75 times the corresponding rectangle(22)'s surface area, but wherein the cross-section(20) has a surface area less than 2 times the corresponding rectangle(22)'s surface area.

4. The cushion of claim 1 wherein the vertical cross-section(20) has a surface area at least 2 times the corresponding rectangle(22)'s surface area, but wherein the cross-section(20) has a surface area less than 3 times the corresponding rectangle(22)'s surface area.

5. The cushion of claim 1 wherein the vertical cross-section(20) has a surface area at least 3 times the corresponding rectangle(22)'s surface area, but wherein the cross-section(20) has a surface area less than 4 times the corresponding rectangle(22)'s surface area.

6. The cushion of claim 1 wherein the vertical cross-section(20) has a surface area at least 4 times the corresponding rectangle(22)'s surface area.

7. The cushion of claim 1 where said substantially airtight hollow body forms a collapsible wrist support.

8. The cushion of claim 1 where a means (9 and 17) is provided to affix an end portion(3), whereby moving said pair of end portions(3) to said erect configuration can be facilitated by not having to handle said pair of end portions(3) simultaneously.

9. The cushion of claim 1 wherein a bottom portion(*2b*) of said longitudinal portion(1) includes a plurality of flexibly joined, relatively stiff base members(7).

10. The cushion of claim 9 wherein the means to move the end portions(3) into said erect configuration operate on the top of the stiffened end portions(3), whereby torque is achieved for moving the end portions(3) into said erect configuration.

11. The cushion of claim 1 where independent, removable, relatively rigid end members(11) line the end portions(3) and are the means by which the end portions(3) are stiffened.

12. The cushion of claim 1 wherein said opposed end portions(3) have attached pockets(10), and said stiffening means is provided by the insertion of independent, rigid end members(11) in the pockets(10).

13. The cushion of claim 12 wherein said pockets have a pocket hole(16) for the passing through of an erecting mechanism(4), whereby the means for moving the stiffened, end portions(3) to said erect configuration is partially provided.

14. The cushion of claim 1 wherein the hollow body, when the end portions(3) are in said erect configuration, still comprises a rectangular foundation(18), which is a substantially box-like, longitudinal section of said substantially airtight hollow body if the hollow body were imaginarily truncated horizontally when the end portions(3) are in said erect configuration.

15. A multi-unit embodiment comprising a plurality of cushions as described in claim 14 in juxtaposed position along the longitudinal, vertical sides of their rectangular foundations(18).

16. A substantially supportive cushion comprising:

a) a substantially airtight hollow body comprising:

i) a pair of end portions(3), made of substantially air impervious material, said end portions(3) being substantially opposed when in an erect configuration;

ii) a longitudinal portion(1), made of substantially air impervious material, a portion of which is flexible, said longitudinal portion interconnected to the end portions(3) around the edges of the end portions(3) and forming said substantially airtight hollow body with the end portions(3), said longitudinal portion(1) and said pair of end portions(3) shaped such that when the end portions(3) are opposed in said erect configuration, a transverse, vertical cross-section(20) of said longitudinal portion(1) has a surface area at least 1.3 times the surface area of its corresponding rectangle(22), where the corresponding rectangle(22) is the rectangle with equal perimeter and equal width, where width is deemed as the cross-section(20)'s biggest dimension, but wherein the cross-section(20) has a surface area less than 1.5 times the corresponding rectangle(22)'s surface area;

b) a means to stiffen the end portions(3), whereby a means to move the end portions(3) into said erect configuration will ordinarily be available prior to use;

c) a valvular means(5) that controls the flow of air between the interior and exterior of said substantially airtight hollow body, such that moving the end portions(3) into said erect configuration causes a surrounding atmospheric pressure to inflate said substantially airtight hollow body, but such that air is prevented from escaping said substantially airtight hollow body during use of the cushion.

* * * * *